US005409404A

United States Patent [19]

Reed

[11] Patent Number: 5,409,404

[45] Date of Patent: Apr. 25, 1995

[54] ELECTRICAL CONNECTOR WITH SLOTTED BEAM CONTACT

[75] Inventor: Carl G. Reed, Clemmons, N.C.

[73] Assignee: The Whitaker Corporation, Wilmington, Del.

[21] Appl. No.: 184,814

[22] Filed: Jan. 21, 1994

[51] Int. Cl.[6] ..... H01R 13/405

[52] U.S. Cl. ..... 439/736; 439/396

[58] Field of Search ..... 439/738, 396, 409

[56] References Cited

U.S. PATENT DOCUMENTS

| | | | |
|---|---|---|---|
| 3,497,952 | 3/1970 | King et al. | 439/736 X |
| 3,611,264 | 10/1971 | Ellis | 339/99 R |
| 3,798,587 | 3/1974 | Ellis, Jr. et al. | 339/97 P |
| 3,993,396 | 11/1976 | Eigenbrode | 439/736 |
| 4,118,095 | 10/1978 | Berglund et al. | 339/99 R |
| 4,136,628 | 1/1979 | McGonigal et al. | 113/119 |
| 4,619,493 | 10/1986 | Kikuta | 339/91 R |
| 4,638,559 | 1/1987 | McGonigal | 29/874 |

*Primary Examiner*—Eugene F. Desmond
*Attorney, Agent, or Firm*—William B. Noll

[57] ABSTRACT

The invention relates to an electrical connector, or wire connecting block, of the type for electrically interconnecting a set of first conductors to an associated set of second conductors. The connector comprises a dielectric housing defined by a pair of side walls and containing a plurality of through cavities therebetween. The cavities for slidably receiving a like plurality of slotted beam contacts are characterized by a first uniform width over a portion of its length, a second portion having a uniform width greater than the first uniform width, and an angled wall transition portion between the uniform portions. Externally, the housing is provided with a like plurality of thin walled sections along one of the side walls, where each said thin walled section is aligned with a corresponding angled wall transition portion within a given cavity. Into the cavity a slotted beam planar contact is received, where the contact comprises a mid body portion and a pair of opposing end portions each containing an insulation displacing slot for receiving a conductor. The mid body portion includes a lance struck therefrom and angled to abut the angled wall transition portion, whereby to secure the contact against movement in a first direction. Finally, after loading the contact into the cavity, the thin walled section is partially severed, such as by a sharp tool, to allow hinging movement of the section into its respective cavity adjacent said lances, whereby to secure the contact against movement in a second direction.

5 Claims, 3 Drawing Sheets

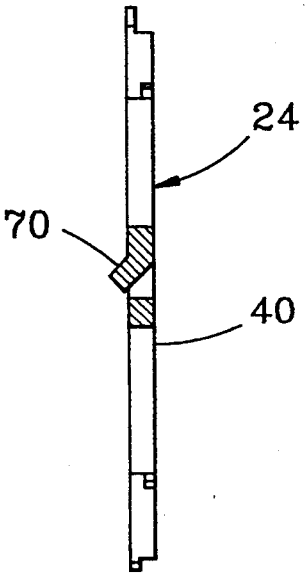
Fig. 3
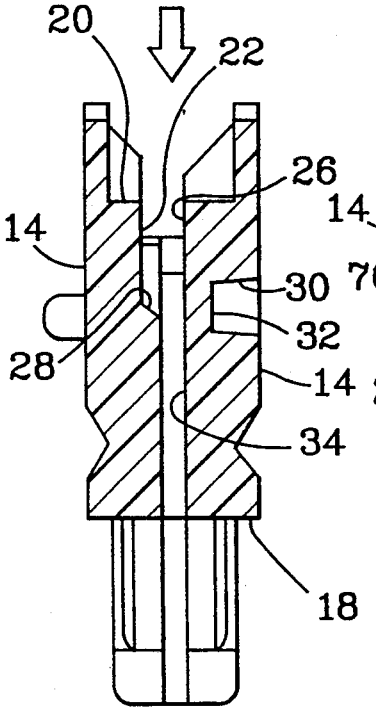
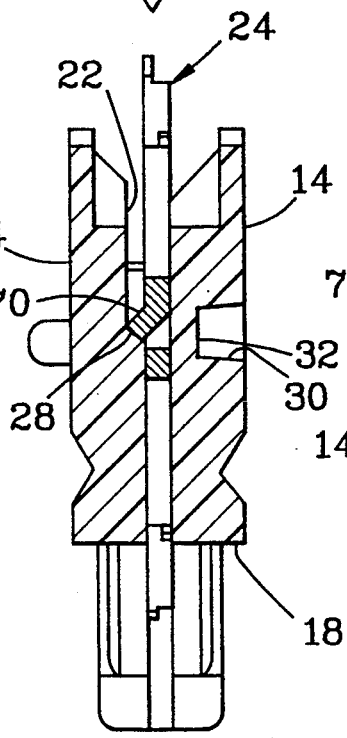
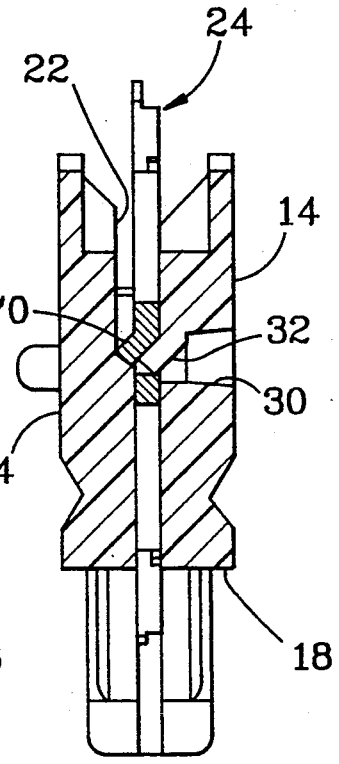
Fig. 2
Fig. 4

ELECTRICAL CONNECTOR WITH SLOTTED BEAM CONTACT

BACKGROUND OF THE INVENTION

This invention is directed to an electrical connector of the type known as a wire connecting block, where such connecting block typically includes a plurality of parallelly arranged slotted beam contacts.

A wire connecting block is a commercial product used in the telephone industry to electrically interconnect a set of first conductors to an associated set of second conductors. An early example of a wire connecting block is taught in U.S.P. No. 3,611,264. The connector thereof includes an indexing strip and a connecting block, the latter of which carries a plurality of slotted beam contacts. The indexing strip has a plurality of uniform height, spaced-apart teeth along its length. These teeth aid in indexing a first set of conductors. A corresponding plurality of uniform height, spaced-apart teeth carried by the connecting block serve to index a second set of conductors to be cross-connected through the slotted beam contacts to the first set of conductors.

There have been various improvements thereto over the years, such as those proposed by U.S.P. Nos. 3,798,587 and 4,118,095. However, none appear directed to the stability of the connector, particularly in fixedly securing the slotted beam contacts therein. It will be appreciated that a considerable normal force must be applied to the contact to effect termination thereto by the displacing of the conductor insulation and pushing such conductor into the slot between the contact arms. In the wire connecting blocks sold commercially, most experience considerable "play" in the seated contacts. Attempts have been made to reduce this "play" by the provision of an insert projecting through the wall of the connector housing and through the cavity. However, even with this approach, some "play" remains. The present invention, by a unique cooperation between the housing and the contained contacts, substantially eliminates the "play" and provides improved stability of the connector during termination thereof. The unique features of this invention will become more apparent in the description which follows, particularly when read in conjunction with the accompanying drawings.

SUMMARY OF THE INVENTION

This invention relates to an electrical connector of the type for electrically interconnecting a set of first conductors to an associated set of second conductors. The connectors, also known as a wire connecting block as used in the telephone industry, comprises a dielectric housing defined by a pair of side walls. Within the housing are a plurality of through cavities, where the length of the cavities are characterized by a first uniform width over a portion of its length, a second portion having a uniform width greater than the first uniform width, and an angled wall transition portion between the uniform portions. Finally, the housing includes a like plurality of thin walled sections along one of the side walls, where each of the thin walled sections is aligned with a corresponding angled wall transition portion within a given cavity. A slotted beam planar contact is received in each of the cavities, where the contact comprises a mid body portion and a pair of opposing end portions each containing an insulation displacing slot for receiving a conductor. The mid body portion is provided with a lance struck therefrom and angled to abut the angled wall transition portion. By this arrangement the contact is secured against movement in a first direction as pressure is applied thereto during conductor termination. Further, the thin walled sections are partially severed with a tool from the respective side wall to allow hinging movement thereof into the respective cavities adjacent the lances. This action secures the contact against movement in a second direction, i.e. in the opposite direction during termination of the other set of conductors.

BRIEF DESCRIPTION OF DRAWINGS

FIGS. 2 to 4 is a sequence of sectional views illustrating the loading of a contact into a dielectric housing, followed by views of the system for fixedly securing the contact within the housing.

PREFERRED DESCRIPTION OF PREFERRED EMBODIMENT

The present invention is directed to an improved, contact stabilized wire connecting block of the type for electrically interconnecting a set of first conductors to an associated set of second conductors. The electrical connector of this invention is illustrated in FIG. 1, while sectional views are offered in FIGS. 2–5 to show the particular manner by which the contained contacts are stabilized therein.

Figure 1:
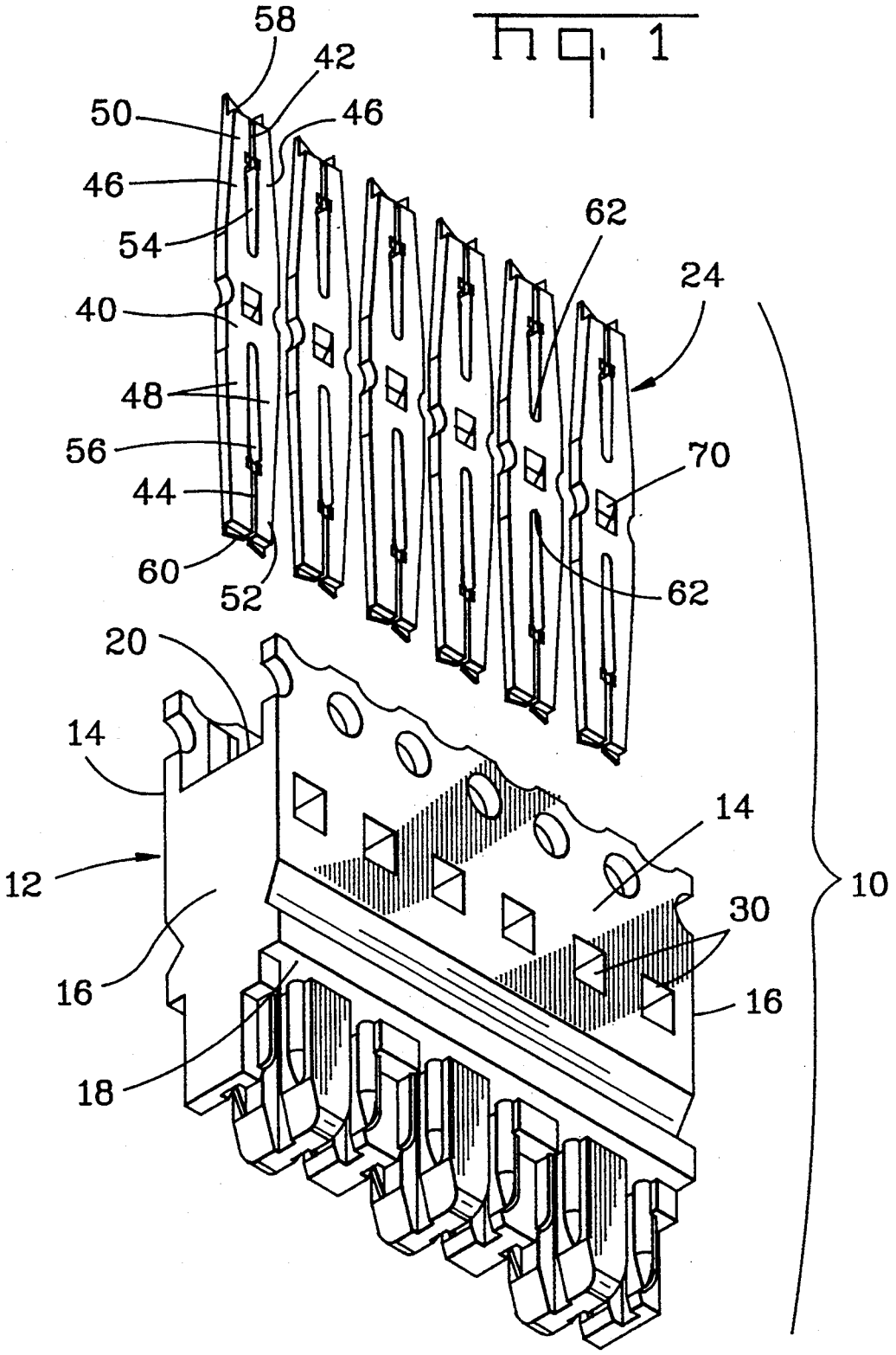
FIG. 1 is an exploded perspective view of the type of an electrical connector suitable for electrically interconnecting a first set of conductors to an associated second set of conductors by the practice of this invention.
Figure 5:
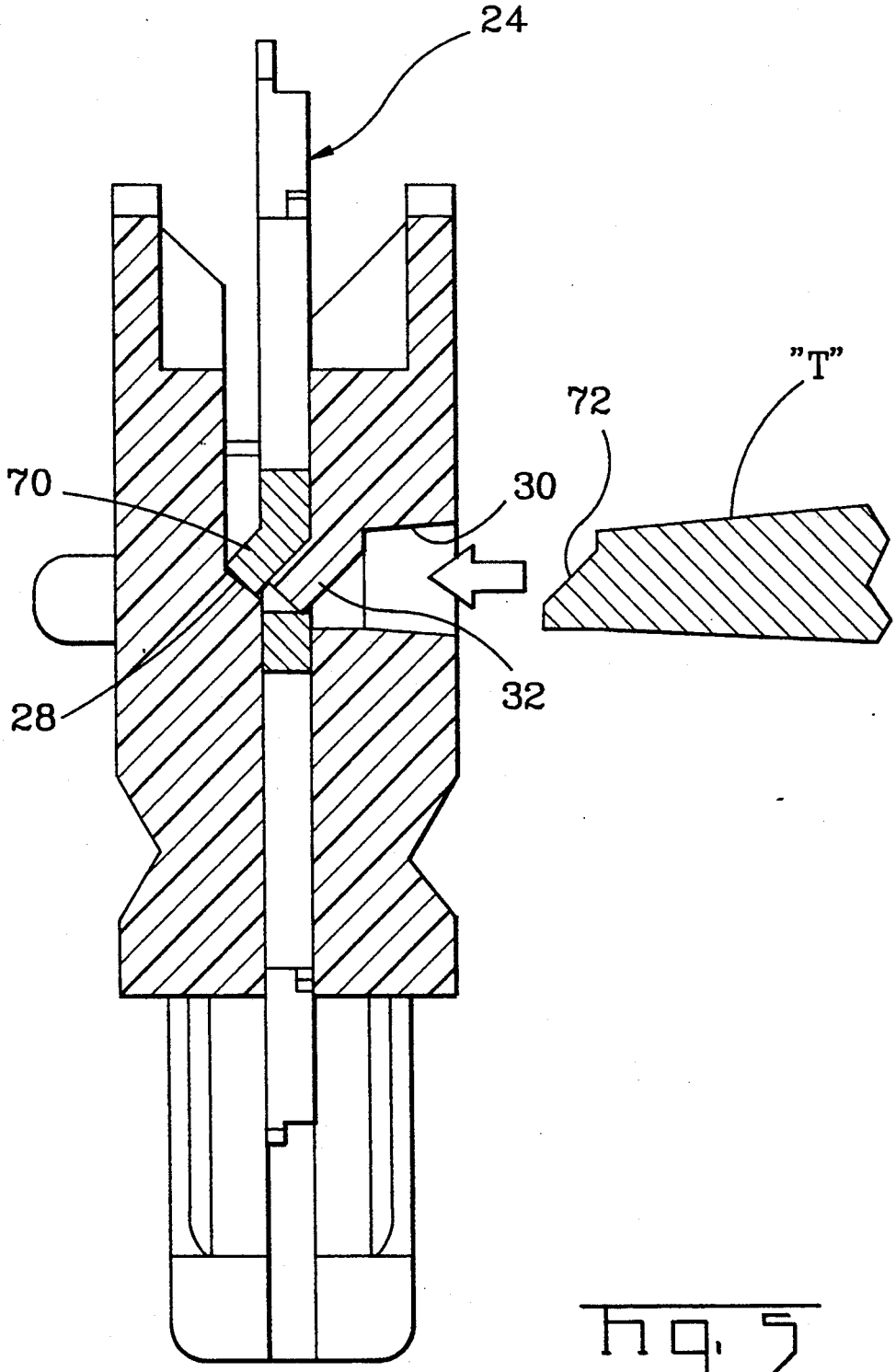
FIG. 5 is an enlarged sectional view, similar to FIG. 4, illustrating the manner by which the final latching of the contact is achieved.

The electrical connector 10 according to this invention, and illustrated in FIG. 1, comprises a dielectric housing 12, typically formed of plastic, having a pair of side walls 14, a pair of end walls 16, a first mating face 18, and a contact loading face 20. Within the housing 12, as best seen in the sectional views of FIGS. 2–5, are a plurality of cavity slots 22 for receiving and retaining the slotted beam planar contacts 24, as hereinafter described. The cavity slots 22 may be further characterized by a first width 24, sized to slidable receive the body of contact 24, a second width 26 greater than said first width 24, and a transition section 28 about midway within the slot. The transition section 28 is preferable angled for reasons to become apparent hereinafter.

Along one wall 14 of the housing 12 are a plurality of recesses 30, one for each cavity slot 22, leaving a thin walled section 32 forming part of the wall 34 of cavity slot 22. The recess 30, and hence the thin walled section 32, are aligned with the angled transition section 28. Preferably the recesses 30 are rectangular in configuration for receipt of a comparably configured tool.

The preferred slotted beam planar contacts 24 of this invention, to be received and retained within the cavity slots 22, are best illustrated in FIG. 1. As known in the art, contacts of this type are typically stamped from a planar strip of sheet metal, such as phosphor bronze, by an operation which advances the strip incrementally through a plurality of work stations, where stamping and peening steps may be performed on the strip. The resulting contact 24, as illustrated in FIG. 1, consists of a mid body portion 40, and a pair of insulation cutting and conductor receiving slots 42, 44 formed by the respective pairs of arms 46, 48 extending from the mid body portion 40. The pairs of arms 46, 48 are bifurcated to form furcations 50—50 and 52—52, respectively, with inner portions forming enlarged elongated openings 54, 56 adjacent the mid body portion 40, and with outer portions closing towards each other to form slots 42, 44 having predetermined width characteristics for receiving insulated conductors, not shown. An insulated conductor typically includes a conductive element or wire covered with an insulation, such as, for example, polyethylene, polypropylene, or PVC. Typically, as known in the art, the outermost ends 58, 60 are tapered to form a relatively sharp V-shaped entrance to the conductor receiving slots 42, 44 to thereby facilitate displacing of the insulation and termination of such conductor.

To control the width of the conductor receiving slots of certain prior art contacts, peening along the outer edges of the arms have been performed as a way of closing the gap or conductor receiving slot between the arms. In contrast, it was discovered with the present invention that work hardening or peening centrally at the base 62 of the slots 42, 44 offered improved performance. Rather than closing the gap, the gap or slots 42, 44 are opened to a more precisely controlled dimension.

Finally, since significant forces are applied to the contacts during termination operations, it is important to be able to fix the contact 24 relative to the housing 12. By this invention, as a further operation of the stamping process, a lance 70 is struck from the mid body portion 40 of the contact 24, where such lance 70 is acutely angled from said mid body portion. In loading the housing 12, as best seen in the sequence illustrated in FIGS. 2 to 4, the lance 70 is caused to rest against the angled transition section 28. In other words, such angled section functions as a "stop" to further movement of the contact toward first mating face 18. Once the contact 24 is fully seated in the cavity slot 22 (FIG. 3), a sharp tool "T" having a tapered tip 72, see FIG. 5, may be caused to enter into the recess 30 where such tool "T" severs three sides of the thin walled section 32 which is then hingedly moved or flexed into the opening created by the lance 70. By this arrangement, the partially severed hinged wall section 32 is flexed into engagement with the lance 70, and thereby positioned to resist movement of the contact in the opposite direction. In other words, "stops" have been created against movement in either of the directions where the forces of conductor termination are significant.

I Claim:

1. An electrical connector of the type for electrically interconnecting a set of first conductors to an associated et of second conductors, the connector comprising a dielectric housing defined by a pair of side walls and containing a plurality of through cavities therebetween where the length of said cavities are characterized by a first uniform width over a portion of its length, a second portion having a uniform width greater than said first uniform width, and an angled wall transition portion between said uniform portions; and, a like plurality of thin walled sections along one of said side walls, where each said thin walled section is aligned with a corresponding angled wall transition portion within a given cavity, a slotted beam planar contact received in each said cavity, where said contact comprises a mid portion and a pair of opposing end portions each containing an insulation displacing slot for receiving a conductor, said mid portion having a lance struck therefrom and angled to abut said angled wall transition portion, whereby to secure said contact against movement in a first direction, and said thin walled sections being partially severed to allow hinging movement thereof into the respective cavities adjacent said lances, whereby to secure said contact against movement in a second direction.

2. The electrical connector according to claim 1, wherein the end portions of said slotted beam planar contact includes said insulation displacing slot at the end and an opening between said slot and said mid body portion, where the slot adjacent said opening is work hardened to control the width of said slot.

3. The electrical connector according to claim 1, wherein said first uniform width is dimensioned to slidably receive said slotted beam planar contact.

4. The electrical connector according to claim 1, wherein said thin walled section is the base of a recess configured to receive a complementary shaped tool to partially sever said thin walled section.

5. The electrical connector according to claim 4, wherein said tool includes an angled cutting tip which hingedly pushes said thin walled section against its respective lance.

* * * * *